US006215353B1

(12) United States Patent
Lewyn

(10) Patent No.: US 6,215,353 B1
(45) Date of Patent: Apr. 10, 2001

(54) STABLE VOLTAGE REFERENCE CIRCUIT

(75) Inventor: Lanny L. Lewyn, Laguna Beach, CA (US)

(73) Assignee: Pairgain Technologies, Inc., Tustin, CA (US)

( * ) Notice: Subject to any disclaimer, the term of this patent is extended or adjusted under 35 U.S.C. 154(b) by 0 days.

(21) Appl. No.: 09/317,277

(22) Filed: May 24, 1999

(51) Int. Cl.[7] ..... G05F 1/10; G05F 3/02
(52) U.S. Cl. ..... 327/538; 323/313
(58) Field of Search ..... 327/538, 539, 327/540, 541, 543, 545; 323/313

(56) References Cited

U.S. PATENT DOCUMENTS

| | | | | |
|---|---|---|---|---|
| 5,059,820 | * | 10/1991 | Westwick | 327/539 |
| 5,352,972 | * | 10/1994 | Pernici et al. | 323/313 |
| 5,563,504 | * | 10/1996 | Gilbert et al. | 323/316 |
| 5,867,012 | * | 2/1999 | Tuthill | 323/313 |
| 5,945,871 | * | 8/1999 | Kausel et al. | 327/538 |

* cited by examiner

*Primary Examiner*—Terry D. Cunningham
*Assistant Examiner*—Quan Tra
(74) *Attorney, Agent, or Firm*—Jeffrey Slusher

(57) ABSTRACT

The invention provides a stable voltage reference circuit that has a single reference diode junction. Two separate current sources are switched so as to alternately apply a first and second current to the junction, with the second current being larger than the first. The voltage over the junction thereby alternates between a first AC input voltage (V1) that has a positive temperature dependence (dV1/dT) and a second AC input voltage (V2) that has a negative temperature dependence (dV2/dT). Combining circuitry is included for adding the first and second input voltages and for thereby generating an output voltage (Vref) substantially constant with absolute temperature. The combining circuitry preferably includes an amplifier that has, for the first input voltage, a gain substantially equal to the ratio of the negative temperature dependence divided by the positive temperature dependence. The amplifier is preferably implemented as an AC amplifier, with input and feedback elements that include a monolithic capacitor network.

9 Claims, 2 Drawing Sheets

STABLE VOLTAGE REFERENCE CIRCUIT

BACKGROUND OF THE INVENTION

1. Field of the Invention

This invention relates to a temperature-compensated, solid-state voltage reference.

2. Description of the Related Art

Stable voltage references traditionally called "bandgap references" are commonly used in a wide variety of applications, including telecommunications. These references typically combine a small voltage, which is directly proportional to absolute temperature, with a larger voltage, which has a negative temperature coefficient. The two voltages are produced by two different diodes operating at current densities typically in the range of 10:1. The voltage difference between the two is then amplified by a DC amplifier with a gain that is established by the ratio of a polysilicon resistor divider. The goal of this voltage combination is to produce a substantially constant reference voltage over a wide temperature range.

There are, however, several sources of problems one encounters when trying to realize accurate, stable voltages using these conventional temperature-compensating voltage references. For example, the small difference between the voltages is directly proportional to absolute temperature. This voltage difference is typically only about 60 mV, but it varies approximately 0.2 mV per degree Celsius.

Because the voltage that is proportional to absolute temperature is small, the initial amplifier offset voltage can produce large changes in the reference voltage. For example, a 1.2 mV change in amplifier offset voltage can produce a 10 mV change in the initial reference voltage. In addition, small variations in the amplifier offset voltage or stress-induced changes in the polysilicon resistor divider ratio can produce large changes in the reference voltage.

Other sources of error include small variations in temperature between the diode elements themselves. For example, a temperature difference of less than 0.5° C. between diode elements or amplifier input elements can produce a voltage difference of 1 mV at the reference output. Such errors can be significant, particularly during the time after switching from standby to full power in the chip that incorporates the reference.

A typical design goal for a voltage reference is the production of a device with better than one percent accuracy over a wide temperature range. Despite considerable research effort, only a few manufacturers of integrated circuits have been able to obtain such accuracy. Even where this accuracy has been achieved, however, it has typically been necessary to add complex circuits to the basic design discussed above. This, in turn, has required considerable chip area in order to compensate for several undesirable effects in the basic reference circuit. These circuits commonly include, for example, trimming circuits capable of adjusting the reference voltage after wafer probe and packaging.

In addition to increased chip area, these designs normally also require significant testing time to adjust the reference voltage. Unfortunately, reference voltage adjustments made at the wafer probe do not generally hold through the packaging process. Stress induced by the packaging process typically causes an accuracy in the voltage reference of better than one percent to become worse than one percent after packaging.

What is needed is therefore a voltage reference that provides the desired accuracy not only in theory but in practice, even after packaging, that does not require complex additional circuitry or long testing periods, and that can be implemented using easily calibrated and matched components.

SUMMARY OF THE INVENTION

The invention meets this need by providing a stable voltage reference circuit that has a single reference diode junction, which may be implemented, for example, as a single diode junction or as a junction of a diode-coupled transistor. A current generating arrangement alternately generates and applies to the diode junction a first current and a second current. The second current is larger than the first current, and a voltage over the diode junction thereby alternates between a first AC input voltage (V1) that has a positive temperature dependence (dV1/dT) and a second AC input voltage (V2) that has a negative temperature dependence (dV2/dT). Combining circuitry is included for adding the first and second input voltages and for thereby generating an output voltage (Vref) substantially constant with absolute temperature.

The current generating arrangement preferably comprises two different current sources—a first current source that generates the first current and a second current source that generates the second current. A first switch then alternately switches the first and second currents into the single reference diode junction.

The combining circuitry preferably includes an amplifier that has, for the first input voltage, a gain substantially equal to the ratio of the negative temperature dependence divided by the positive temperature dependence. The amplifier is preferably part of an amplification arrangement in which the amplifier is an AC amplifier with input and feedback elements that include a monolithic capacitor network.

The preferred embodiment of the voltage reference circuit includes a capacitor network that determines the gain of the amplifier. This capacitor network preferably includes a first capacitor with a first capacitance (C1) in a first signal path for the first input voltage and a second capacitor with a second capacitance (C2) in a second signal path for the second input voltage, in which both signal paths lead to a summing junction of the amplification means and the ratio of C2 to C1 is equal to the gain of the amplification means.

A second switch is preferably included in the invention and is connected, via the second capacitor, to the summing junction. The second switch alternately connects the summing junction, via the second capacitor, to the first input voltage when the first input voltage is equal to a maximum input voltage and otherwise to a system ground.

In the preferred embodiment of the invention, the voltage reference circuit further has a feedback path from the output voltage (Vref) to a summing junction of the amplification amplifier. A third switch is then preferably included in the feedback path to alternately connect the summing junction, via a third capacitor, to either the output voltage Vref or to circuit ground.

DETAILED DESCRIPTION

Figure 1:
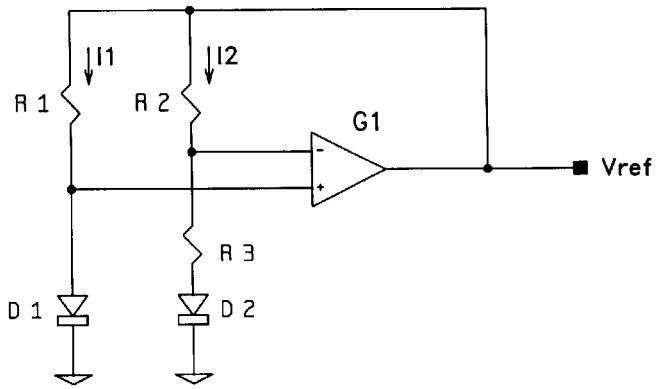
Figure 1 (Prior Art)
FIG. 1 shows the main components of a matched-diode voltage reference according to the prior art.

Although FIG. 1 shows the main components of a matched-diode voltage reference according to the prior art, it is helpful to study its structure at least cursorily because the concepts used in the invention will then become clearer, as will the advantages of the invention.

In the conventional arrangement illustrated in FIG. 1, two currents I1 and I2 are generated in a conventional manner and are passed to ground through respective diodes D1 and D2. In practice, these elements will typically be implemented as diode-connected PNP transistors, with the emitter-base junctions forming the "diodes." These elements are therefore referred to below as either "diodes" or "transistors" D1 and D2, since, regardless of how they are implemented, their functions and electrical properties will be the same. In this discussion, "I1" and "I2" refer to the currents through resistors R1, for I1, and through R2+R3, for I2.) It is known that:

$$I=k\cdot A\cdot \exp\,(V/V_t),$$

where:

I is the emitter current;

k is a known constant;

A is the emitter-base junction area;

V is the emitter-base junction voltage; and $V_t$ is a known, temperature-dependent voltage parameter that is roughly 0.026 V at the standard temperature of 27° C. (300° K), which is a typical operating temperature for voltage reference circuits.

Dual-diode voltage reference circuits such as the one illustrated in FIG. 1 typically apply equal currents (I1=I2) to the emitters, but the emitter areas are unequal, which results in different emitter current densities. For example, if the diode D1 has an emitter area A1, then the diode D2 may have an emitter area A2=r·A1. Substituting these values in the expression above, setting I1=I2 (or, equivalently, letting A1=A2 and generating I1=r·I2), and taking the ratio of I1 to I2, one finds the following difference between the voltages V1, V2 at the D1, D2 emitters to be:

$$V1-V2=V_t\cdot \mathrm{In}\,[(A2/A1)\cdot(I1/I2)]=V_t\cdot \mathrm{In}\,(r)$$

Now assume that r=10, which is a typical value. Then (V1−V2)—the difference voltage—becomes 0.060 V, that is, 60 mV, for $V_t$=0.026. Note, however, that $V_t$ is proportional to absolute temperature and is often referred to in the literature as the "thermal voltage." V1−V2 is therefore proportional to absolute temperature and is commonly referred to as the "PTAT voltage." On the other hand, as long as I1 and I2 are kept equal and within normal ranges, the PTAT voltage remains relatively constant at 60 mV, independent of I1 and I2.

As is well known, the voltage V2 across a conventionally fabricated transistor (diode-connected) such as D2 is approximately 650 mV. It can also be shown that, at the standard temperature of about +27° C., this voltage V2 decreases approximately 1.6 mV/° C.; at −40° C., however, V2 decreases about 1.8 mV/° C.; and at +85° C., it decreases around 2.0 mV/° C. In other words, the temperature sensitivity of the voltage over the D2 junction is non-linear—it "bends" downward as the temperature increases.

On the other hand, as the expression (V1−V2)=$V_t$·In (r) shows, the PTAT voltage increases linearly with increasing temperature (since $V_t$, increases). It can be shown that, in this example, the PTAT voltage (V1−V2) increases approximately 0.22 mV/° C. and that this temperature dependency is essentially linear at all expected operating temperatures. Increases in temperature that cause the PTAT or "diode difference" voltage to rise therefore will cause the larger voltage V2 itself to fall.

Quantitatively, the change in the PTAT voltage (V1−V2) is approximately +0.22 mV/° C., whereas the change in V2 at mid-range temperature is approximately −1.87 mV/° C., which is 8.5 times greater than the change in the PTAT voltage. This PTAT voltage is then amplified by the gain-setting resistor ratio R3/(R2+R3), where the gain is chosen to be 8.5, which produces an output of 510 mV with a temperature dependence of 8.5*(0.22)=+1.87 mV/° C. In other words, the PTAT voltage is amplified so that the resulting amplified signal's temperature dependence is of the same magnitude but of opposite polarity as that of the voltage V2.

Near the middle of the operating temperature range, the deviations in the amplified PTAT voltage and in V2 thus theoretically "cancel" each other upon addition. To perform this "addition," the amplified PTAT voltage and the voltage V1 over the junction of transistor D1 (which, as is mentioned above, is connected to function as a diode) are summed by these scaling resistors R2, R3 in the output stage of FIG. 1. In the illustrated example, the resistors R1, R2 and R3 are assumed to have been selected using conventional methods to produce the desired output reference voltage, Vref of, for example, 1.2 V, which is nearly temperature-independent and approximately equal to the bandgap voltage of silicon.

As is mentioned above, there are several problems with this conventional design. First the polysilicon resistor divider ratio R2/(R2+R3) must be precisely and exactly matched, as must the currents over the transistor junctions, which are set by the ratio R1/(R2+R3). Second, the "diode" temperatures must be as nearly equal as possible. Observe not only that the exact matching of resistors is relatively difficult, but also that the task is complicated by the fact that the resistor values used are subject to local values of wafer stress, which change with temperature and after encapsulation in the packaging process. Third, the DC offset voltage of the operational amplifier G1 changes with temperature and packaging stress, particularly if it is fabricated using MOS technology.

Figure 2:
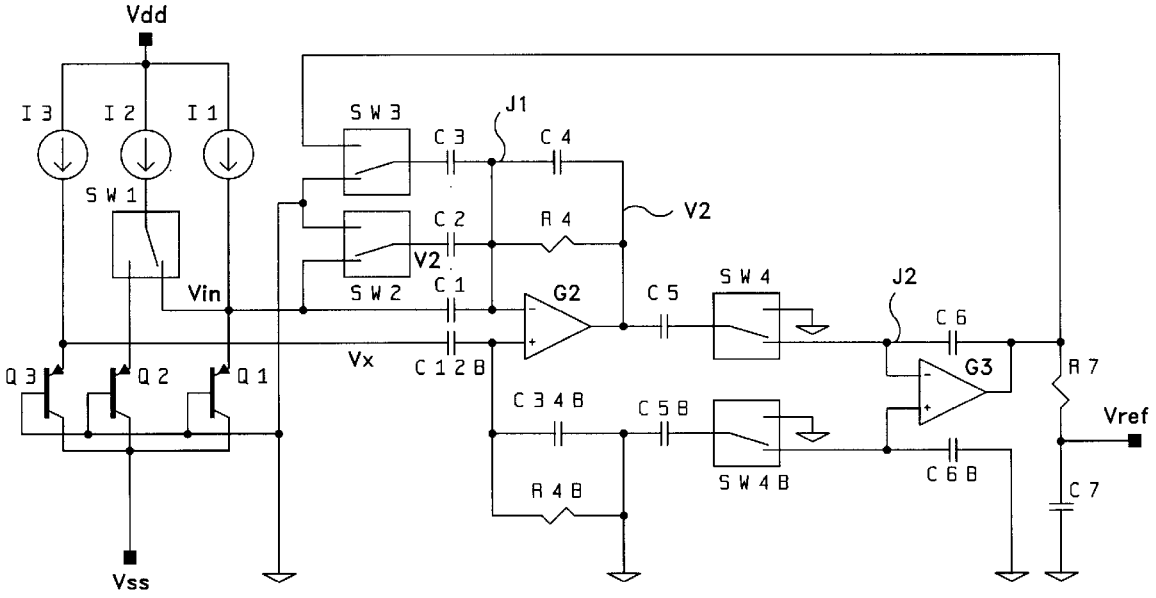
FIG. 2 shows the voltage reference according to the invention, which has a single reference diode junction.

FIG. 2 illustrates the stable voltage reference circuit according to the invention. The various components and their interconnections are described first. Thereafter, values are assigned to the components in order to demonstrate how the circuit works and why it works better than the prior art.

In the invention, two primary current sources I1 and I2 (or a single current generator that is able to switch between generating currents I1 and I2) are provided as before, but only a single primary reference diode is needed. In the preferred embodiment of the invention, the diode is constructed from a diode-connected PNP transistor Q1. The function and properties of Q1 are therefore the same as for a "normal" diode. Using MOS technology to fabricate the transistor, Q1 has a typical emitter area of 50 $\mu m^2$, the N-Well serves as the base and is connected to circuit ground, and the collector is the P-type substrate.

In FIG. 2, two voltage values Vdd and Vss are shown. Vdd is the highest voltage and is provided by any conventional voltage source (not shown); Vss is the substrate voltage.

According to the invention, the first current source I1 is always connected to Q1, whereas the second current source I2 is switched by a conventional solid-state switch SW1 either into Q1, or via a dummy load such as a diode-connected transistor Q2 to ground. As the switch SW1 switches between these two states, it creates an alternating voltage signal Vin that is converted to an alternating charge signal by an input capacitor C1. This alternating charge signal is then delivered to the summing junction J1 of a gain element G2.

Figure 3:
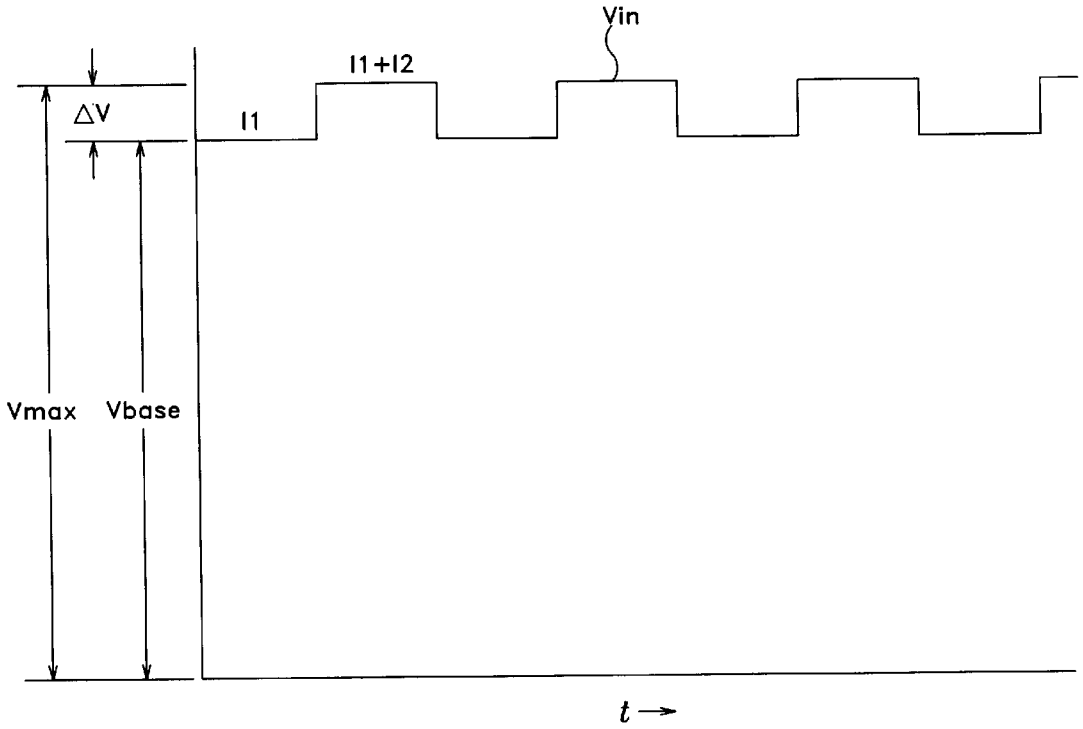
FIG. 3 illustrates the voltage over the single diode or diode-connected transistor.

The Vin switching waveform is shown in FIG. 3. The figure shows Vin switching between a base voltage Vbase and a maximum voltage Vmax with an AC amplitude equal to ΔV, which, in this example, is about 60 mV. The voltage ΔV is proportional to absolute temperature but is AC in nature, as opposed to the DC nature of the PTAT voltage in circuits of the prior art. Because the PTAT voltage is AC in nature, it can be amplified using AC gain elements. Moreover, the DC offset voltage of AC gain elements does not affect the accuracy of the AC output signal.

The summing junction J1 is also connected, via a second capacitor C2, to a second solid state switch SW2. Switch SW2 connects the C2 input alternately to ground and to Vin. Switch SW2 is phased, using known techniques, so that it connects C2 to Q1 when the voltage Vin is equal to Vmax. This occurs during the same clock phase when I2 is connected to Q1 by SW1. The charge delivered through C2 is therefore proportional to Vmax.

In the prior art circuit of FIG. 1, the PTAT voltage was derived from two separate diodes by setting their current densities to be different by a factor of 10. IN contrast, in the circuit of the present invention, the PTAT voltage is derived from a single diode operating with a current density difference resulting from the difference between I1 and I2. Where the desired current ratio is m, the required ratio I2/I1=m−1. Therefore if m=10 and I1 is chosen to be 15 μA in the preferred embodiment of the present invention, I2=I1 (m−1) or 135 μA.

With reference to FIG. 3, it can be shown that the temperature dependence of ΔV is proportional to Vo(Tk/300), where Vo is the voltage at a baseline temperature of 300° K and Tk is the temperature in degrees Kelvin. Thus the PTAT temperature coefficient d(ΔV)/dT=+0.22 mV/° C.

On the other hand, Vmax has the non-linear temperature dependency described previously, that is approximately −1.6 mV/° C. at −40° C., −1.8 mV/° C. at 27° C., and −2.0 mV/° C. at +85° C. In other words, ΔV depends linearly on absolute temperature (T) whereas Vmax does not. For a nominal design where a near-zero temperature coefficient of voltage is desired near the middle of the operating temperature range, the 27° C. value of −1.8 mV/° C. may be assumed for the temperature coefficient of Vmax.

As in the prior art, the negative temperature dependence of 1.8 mV/° C. for Vmax is approximately equal to 8.5 times the positive temperature dependence of 0.22 mV/° C. for ΔV. In one embodiment of this invention, the capacitance of C1, which couples the PTAT voltage source Vin to the summing junction J1, is therefore chosen to be 8.5 times the capacitance of C2, which couples the Vmax negative temperature coefficient voltage source to the same summing junction J1.

The switching frequency of all switches is the same and may be chosen using normal design considerations. It should be low enough to ensure proper settling of all gain elements. In one prototype of the invention, for example, the switching frequency of SW1 was chosen to be 9 MHz because gain-element settling time constants of a few nano-seconds (ns) are easily achieved using 0.35 μm CMOS technology.

The voltage reference circuit according to this invention achieves the correct output voltage Vref preferably by means of a feedback loop. This feedback loop includes a connection from the output voltage point Vref back to an input switch SW3, which alternately switches Vref and circuit ground to the input of a capacitor C3. The third switch SW3 is synchronized, again, using any known technique, to the first two switches SW1 and SW2 such that SW3 grounds the input of C3 when switch SW1 connects the second current source I2 to Vin (that is, to Q1) and switch SW2 connects the capacitor C2 to Vin (Q1).

When the desired reference voltage Vref has been driven to the correct amplitude, the negative charge pulled from the summing junction J1 through C3 when SW3 switches to ground will approximately equal the sum of the positive charge deposited on the input through C1 as Vin switches from Vbase to Vmax and the positive charge deposited on the input when the input to C2 switches from ground to Vmax.

Any charge errors will be amplified by the AC-coupled gain element G2 in accordance with the value of the value of a feedback capacitor C4, which is coupled between the output of gain element G2 and the summing junction J1, to produce an AC output voltage V2. When the negative charge pulled from summing junction J1 through the capacitor C3 is not quite equal to the positive charge from capacitors C1 and C2, then the small positive charge will result in a negative output at V2 when a switch SW4 connects the summing junction J2 of an amplifier G3 to the output voltage V2 via the capacitor C5.

A feedback resistor or resistive element R4 is also included between the output of the gain element G3 and the summing junction, in parallel with the feedback capacitor C4. The current across this resistor R4 will typically be very small, on the order of 1 pA. The resistance of R4 may therefore be high, on the order of 100 MΩ or higher, without causing any undesirable effects on the DC performance of the circuit.

The gain element G2 therefore operates as a conventional AC amplifier and is not subject to the offset voltage inaccuracies of the prior art DC amplifiers used to amplify the small (approximately 60 mV) PTAT signal. The AC gain of element G2 with respect to the signal Vin may therefore be quite high. For example, the gain from Vin to G2 output is C1/C4 and may, in a typical implementation, have a value such as 17 for C1=17 unit capacitors and C4=1 unit capacitor.

The invention preferably also includes a second, output stage, in which the switch SW4 connects a summing junction J2 of a gain element G3 to capacitor C5, which forms a second-stage input capacitor, only when the switch SW1 connects the second current source I2 to Q1. In this case, a negative V2 output causes a negative charge to be pulled from the summing junction J2 through C5. This, in turn, causes the output of the gain element G3 to rise in voltage as the charge is integrated across a feedback capacitor C6, which is connected between the output of G3 and the summing junction J2. The voltage across C6 will continue to rise on each successive switching cycle until the charge through C3 approximately balances the sum of the charges through C1 and C2.

When the switch SW4 is not connected to the summing junction J2, it grounds the output of input capacitor C5 so that the charge produced through C5 is proportional only to the AC voltage output of the gain element G2, that is, not to the DC voltage. The operation of the AC amplifier element G2 in combination with the switch SW4 is known in the art as a carrier amplifier-demodulator. As such, the output voltage of switch SW4 depends only on the AC component of the G2 signal and not on the DC components, which are subject to variation from causes such as DC offset.

When the switch SW4 closes to ground, the output of G2 charges C5 to a given voltage. On the opposite switch phase, the output of G2 moves through an AC voltage depending on the error charge from the sum of the charges through C1, C2 and C3 to a new voltage. During the voltage change, SW4 connects the C5 output to the input of gain element G3 so that only the charge from the voltage difference is passed through C5.

The charge produced through capacitor C5 is thus integrated by the combination of the gain element G3 and feedback capacitor C6, and this combination, in connection with the switch SW4, functions in a manner similar to a switched-capacitor integrator. As is known in the art, a switched-capacitor integrator has an advantage over a simple gain amplifier in that small input charge errors are integrated across the feedback capacitor (C6) to drive the closed-loop error voltage toward zero.

Although the invention as described above provides a stable reference voltage, the invention preferably also include noise-canceling circuitry to further improve its performance. As illustrated in FIG. 2, this noise-canceling circuitry includes a third diode or diode-coupled transistor Q3 and a third current source 13 that is coupled both to the substrate voltage Vss through Q3 and to a capacitor C12B, which is connected to the "positive" input of the gain element G3. A capacitor C34B connects this positive input to ground. A noise cancellation capacitor C5B is also connected to ground. A switch SW4B connects the charge on C5B to either ground, or to the "positive" input of the gain element G4, which is also grounded through a capacitor C6B.

A resistor or resistive element R4B is connected from the positive input of G2 to ground. Resistor R4B is preferably constructed in a similar fashion to resistor R4. Exact matching of the R4 construction is not required, however, since DC characteristics are not critical and, without any semiconductor junctions connected to the input circuit, the current flow across either resistor is far below the level of a picoamp.

Figure 4:
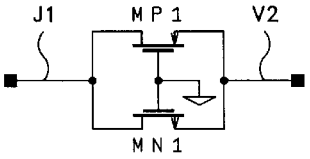
FIG. 4 shows a MOS implementation of a resitive element used in the preferred embodiment of the invention.

In the preferred embodiment of the invention, the resistive elements R4 and R4B are constructed using an NMOS and PMOS device as shown in FIG. 4. When the signal V2 at the output of the amplifier G2 (see FIG. 2) is near ground potential, the resistance of both MOS devices is very high and the amplifier feedback time constant R4·C4 is very long.

For large positive amplitude signals, or when the amplifier output DC value rises to voltages above ground of several hundred millivolts, the resistance of the NMOS device drops to provide negative feedback. For large negative amplitude signals, or when the output DC value drops to voltages below ground of several hundred millivolts, the resistance of the PMOS device drops to provide negative feedback. The action of the NMOS and PMOS devices thus tends to maintain the amplifier output approximately centered around ground potential.

The circuit elements I3, Q3, C12B, R4B, C34B and C5B have little effect on input charge amplification. They are rather present to provide some cancellation of any noise on input current sources I1 and I2. It is well known in the art that for best noise cancellation, the current generated by I3 should be comparable in amplitude to (I1+I2)/2, which, in one prototype of the invention, was roughly 75 $\mu$A. Also, the element Q3 should be of construction similar to that of Q1. Furthermore, the various capacitors' values should be chosen as follows: C12B=C1+C2, and C34B=C3+C4.

Circuit elements C5B, SW4B and C6B provide input noise cancellation for the integrating amplifier G3. It is well known that for best noise cancellation, C5B=C5, SW4B should switch in phase with SW4, and C6B=C6. A seventh capacitor C7 is preferably also included from the output of the integrating amplifier G3 to ground in order to absorb all additional noise generated by integrating amplifier G3, particularly during the switching of the G3 input switch SW4. The capacitor C7 may be a large off-chip ceramic capacitor of value such as 0.1 $\mu$F. Moreover, a resistive element R5 is preferably included between output of G3 and the capacitor C7 in order to act as a loop stabilization resistance; R5 should be chosen using normal design methods to provide a small high-frequency gain for stage G3.

The gain elements G2 and G3 are preferably implemented in conventional MOS technology and operational transconductance amplifiers (OTAs). The transconductances (gm) of G2 and G3 should, in typical implementations, be set at approximately 1 milli-mho. A value of 3 k Ohms for R3 then gives a gm×R3 value of 3 as the high-frequency, open-loop forward gain of stage G3.

Each of the capacitors used in the invention may be either a single device or a group of capacitors connected in parallel to provide the required capacitance. The choice will depend on conventional design considerations and is not essential to the invention. In the preferred embodiment of the invention, however, at least the capacitors C1, C2, and C3 are fabricated as monolithic capacitor networks, since networks provide better tolerances and more stable capacitance ratios. The number of unit capacitors used for C1, C2, and C3 may be chosen using normal design methods and is determined by the requirement for achieving a low temperature coefficient for the output voltage Vref.

It has been previously stated that in one embodiment of the present invention, the C1 capacitance is chosen to be 8.5 times the C2 capacitance. In order to construct C1 and C2 from unit capacitors, C1 may, for example, be a network of 17 unit capacitors, while C2 is a network of two unit capacitors. If C3 is chosen to be two unit capacitors, then, for input charge balance, Vref (C3)=Vmax(C2)+ΔV(C1). Or Vref=Vmax(C2/C3)+ΔV(C1/C3).

The capacitance of C12B should be the equal to the sum of the capacitances for C1+C2, so that, given the values above, it should therefore be made up of a network of 19 capacitors. Similarly, C34B=C3+C4 and should comprise three unit capacitors. The ratio C5/C6 sets the integrator scale factor; setting this ratio to 1/8, for example, provides for stability in the overall Vref control loop. The value for C5 may be selected to be, for example, four unit capacitors, or some other value that is significantly larger than the capacitances of the MOS switch devices. The capacitance of C6 would in such case be 4*8=32 unit capacitors. Given these values of C5 and C6, the capacitance values for C5B and C6B should therefore be chosen as C5B=4 and C6B=32 unit capacitors.

The size of the unit capacitors in the preferred embodiment is 100 femto-Farads (fF). The choice of 100 fF is typical of unit capacitors constructed in 0.35 $\mu$m CMOS technology. The design is not critical with regard to the size of the unit capacitors. With a baseline bias current of, for example, I1=15 $\mu$A, which was, in one prototype, selected for the diode-connected PNP device Q1, there is a sufficiently low drive resistance to drive the 19 unit capacitors in the C1+C2 circuits quite rapidly.

It is well known that the highest dynamic resistance at the Q1 emitter circuit is Vt/I1, where Vt, the thermal voltage, is approximately 26 mV and I1 is the lowest current, or 15 $\mu$A. In that case, the highest resistance is approximately 1.7 kOhms, which is capable of driving the 19 unit capacitors and circuit parasitic capacitance with a time constant faster than 5 ns.

The MOS switch device widths and lengths are not critical and are constructed in accordance with standard design practice. They are preferably constructed at approximately three times minimum width. Using 0.35 $\mu$m CMOS technology, the width will therefore typically be about 1.0 $\mu$m and the length will typically be about 0.35 $\mu$m.

This invention teaches the use of a single diode or diode-connected transistor to provide both polarities of temperature compensation in a precision voltage reference. Note that Q2 is provided only as a dummy load and Q3 is used only in the optional noise-canceling circuit. This use of a single diode (or diode-connected transistor) to provide both polarities of temperature coefficient in combination with MOS capacitors and AC amplifiers has several advantages. The first is that there are no errors present due to the temperature or lithography differences between diodes of unequal area. The second is that it is possible to fabricate the invention with highly accurate circuits using MOS technologies rather than the bipolar technology required for most highly accurate designs.

I claim:

1. A stable voltage reference circuit comprising:

a single reference diode;

current generating means for generating and applying to the diode an alternating current alternating between a first current and a second current, in which the second current is larger than the first current, a first alternating (AC) voltage over the diode thereby alternating between a first input voltage and a second input voltage; and for producing the first AC voltage in proportion to the alternating current and having a positive temperature dependence (dV1/dT) and a magnitude equal to the difference between the second input voltage and the first input voltage;

a first switching means for alternately producing from the diode a second AC voltage having a negative temperature dependence (dV2/dT) and a magnitude equal to the second input voltage;

a second switching means for producing from a DC output voltage (Vref) a third AC voltage having a magnitude substantially equal to the output voltage Vref;

an AC amplifier that has:

as its input an AC amplifier input signal that is the additive combination of first, second and third input charges corresponding to the first, second and third AC voltages;

as its output an AC error signal;

an unswitched feedback path; and an unswitched feedback capacitor that is included in the feedback path and across which a charge error resulting from the sum of the first, second and third input charges is converted into the AC error signal;

demodulation means for demodulating the AC error signal and for converting it into the DC output voltage.

2. A voltage reference circuit as in claim 1, in which the current generating means includes:

a first current source that generates the first current and a second current source that generates the second current; and a first switch that alternately switches the first and second currents into the single reference diode.

3. A voltage reference circuit as in claim 1, in which:

the AC amplifier has, for the first input voltage, a gain substantially equal to the ratio of the negative temperature dependence divided by the positive temperature dependence.

4. A voltage reference circuit as in claim 3, further comprising a capacitor network, included in the AC amplifier, for determining the gain of the AC amplifier.

5. A voltage reference circuit as in claim 4, further comprising a first capacitor with a first capacitance (C1) in a first signal path for the first input voltage, a second capacitor with a second capacitance (C2) in a second signal path for the second input voltage, and a third capacitor with a third capacitance (C3) in a third signal path for the third input voltage, in which the three signal paths lead to a summing junction of the AC amplifier and the ratio of C3 to C2 to C1 is equal to the relative gain, for each input, of the AC amplifier.

6. A voltage reference circuit as in claim 5, further including a second switch that is connected, via the second capacitor, to the summing junction, the second switch alternately connecting the summing junction, via the second capacitor; to the first input voltage when the first input voltage is equal to a maximum input voltage and otherwise to a system ground.

7. A voltage reference circuit as in claim 3, in which the AC amplifier includes a monolithic capacitor network in the unswitched feedback path.

8. A voltage reference circuit as in claim 1, in which the demodulation means includes a switched capacitor AC-to-DC integrator.

9. A stable voltage reference circuit comprising:

A) a single reference diode;

B) current generating means i) for generating and applying to the diode an alternating current alternating between a first current and a second current, in which the second current is larger than the first current, a first alternating (AC) voltage over the diode thereby alternating between a first input voltage and a second input voltage; and ii) for producing the first AC voltage in proportion to the alternating current and having a positive temperature dependence (dV1/dT) and a magnitude equal to the difference between the second input voltage and the first input voltage;

iii) the current generating means including:

a) a first current source that generates the first current and a second current source that generates the second current; and b) a first switch that alternately switches the first and second currents into the single reference diode;

C) a first switching means for alternately producing from the diode a second AC voltage having a negative temperature dependence (dV2/dT) and a magnitude equal to the second input voltage;

D) a second switching means for producing from a DC output voltage (Vref) a third AC voltage having a magnitude substantially equal to the output voltage Vref;

E) an AC amplifier that has:

i) as its input, an AC amplifier input signal that is the additive combination of first, second and third input charges corresponding to the first, second and third AC voltages;

ii) as its output an AC error signal;

iii) an unswitched feedback path;

iv) a monolithic capacitor network in the feedback path and across which a charge error resulting from the sum of the first, second and third input charges is converted into the AC error signal;

v) for the first input voltage, the gain of the AC amplifier gain being substantially equal to the ratio of the negative temperature dependence divided by the positive temperature dependence;

F) a first capacitor with a first capacitance (C1) in a first signal path for the first input voltage, a second capacitor with a second capacitance (C2) in a second signal path for the second input voltage, and a third capacitor with a third capacitance (C3) in a third signal path for the third input voltage, in which the three signal paths lead to a summing junction of the AC amplifier and the ratio of C3 to C2 to C1 is equal to the relative gain, for each input, of the AC amplifier;

G) demodulation means for demodulating the AC error signal and for converting it into the DC output voltage.

* * * * *